United States Patent [19]

Sterling

[11] Patent Number: 4,958,787

[45] Date of Patent: Sep. 25, 1990

[54] KITE

[76] Inventor: Duane M. Sterling, 213 NW. Couch St., Portland, Oreg. 97209

[21] Appl. No.: 321,290

[22] Filed: Mar. 9, 1989

[51] Int. Cl.[5] ..... A63H 27/08

[52] U.S. Cl. ..... 244/153 R; 244/901

[58] Field of Search ..... 244/153 R, 154, 155 R, 244/901, 33; 403/11, 202

[56] References Cited

U.S. PATENT DOCUMENTS

| | | | |
|---|---|---|---|
| 3,347,500 | 10/1967 | Hartig | 244/154 |
| 4,228,977 | 10/1980 | Tanaka | 244/153 R |

FOREIGN PATENT DOCUMENTS

| | | | |
|---|---|---|---|
| 1546790 | 11/1968 | France | 244/901 |
| 481617 | 3/1938 | United Kingdom | 244/153 R |
| 1438198 | 6/1976 | United Kingdom | 244/153 R |

OTHER PUBLICATIONS

Pp. 38 and 39 of Into The Wind, 1988 Kite Catalog.

*Primary Examiner*—Joseph F. Peters, Jr.
*Assistant Examiner*—Christopher P. Ellis
*Attorney, Agent, or Firm*—Eugene M. Eckelman

[57] ABSTRACT

The frame for the kite extends outwardly to side tips at a swept back angle and includes a pair of inwardly disposed extensions leading rearwardly at an angle directed to the opposite side of the kite. The extensions extend across each other at an angle to form the sides of a triangle and a closed reinforcing frame triangle is formed by these extensions in combination with a laterally extending spreader bar. Abutment and friction collars are associated with the frame portions for holding the latter together and for allowing the frame to be wholly or partially disassembled for handling and storage. The kite includes bridles and connecting fly lines to accomplish stunt flying either as a single kite or multiple kites in formation.

9 Claims, 2 Drawing Sheets

KITE

BACKGROUND OF THE INVENTION

This invention relates to new and useful improvements in kites and in particular pertains to kites of the type that are used for stunt flying.

Many forms of kites are in existence, including stunt kites, that are used for recreation, entertainment and contests. One desirable feature of stunt kites is that they be efficient in flight, namely, that they be highly maneuverable and particularly fast turning, readily responsive, and accurate under the control of the operator. Furthermore, it is desired that they be capable of stacking in a train arrangement for formation flying, that they be attractive in appearance, and also that they have structural rigidity to withstand the strain from wind forces and particularly forces of fast flying and turning. Furthermore, it is desirable that the kites be capable of withstanding repeated crashes and be easily repairable, also that they be collapsible so as to be made compact for marketing and storage.

SUMMARY OF THE INVENTION

According to the present invention, it is a general object of the invention to provide a stunt kite that encompasses improved features of flight efficiency, structural rigidity, appearance, and a capability of being compacted when not in use.

With regard to flight efficiency, it is a more particular object to provide a kite that has an overall shape of a narrow profile Delta wing but instead of having a single nose portion, a pair of wing sections form a pair of nose portions in the same flight plane level and arranged structurally similar to bird wings. Such bird wing resemblance makes the kite highly maneuverable and effective for stunt flying. It also provides an attractive appearance.

As to structural rigidity, it is an object of the invention to provide a triangulated frame portion whereby to form a structurally strong kite. Such triangulated frame also provides easy assembly and disassembly for folding into a compacted shape for marketing, handling and storage, and furthermore provides a structural arrangement that releases a portion of the frame in event of impact with the ground, thus absorbing shock and protecting the frame from damage.

In carrying out the objects of the invention, the present kite has frame members at the front extending outwardly to side tips at a rearwardly directed angle and forming a swept back leading edge for the kite. The frame also includes a pair of inwardly disposed members leading rearwardly at an angle directed toward the opposite side. The two inwardly disposed members cross each other and form two sides of a triangle. A spreader bar is connected to the front frame members and crosses the pair of inwardly disposed members to form a matching pair of reinforcing triangles. The kite has bridle means attached to the frame for attachment to two fly lines. Connectors, collars and spacers are used with the frame which hold the kite in its flying shape or allow the kite to be compacted for marketing, handling and storage, and also which provide some releasable frame portions that relieve stress in the overall frame in the event of an impact with the ground.

The invention will be better understood and additional objects and advantages will become apparent from the following description taken in connection with the accompanying drawings.

DETAILED DESCRIPTION OF A PREFERRED EMBODIMENT

Figures 1, 2:
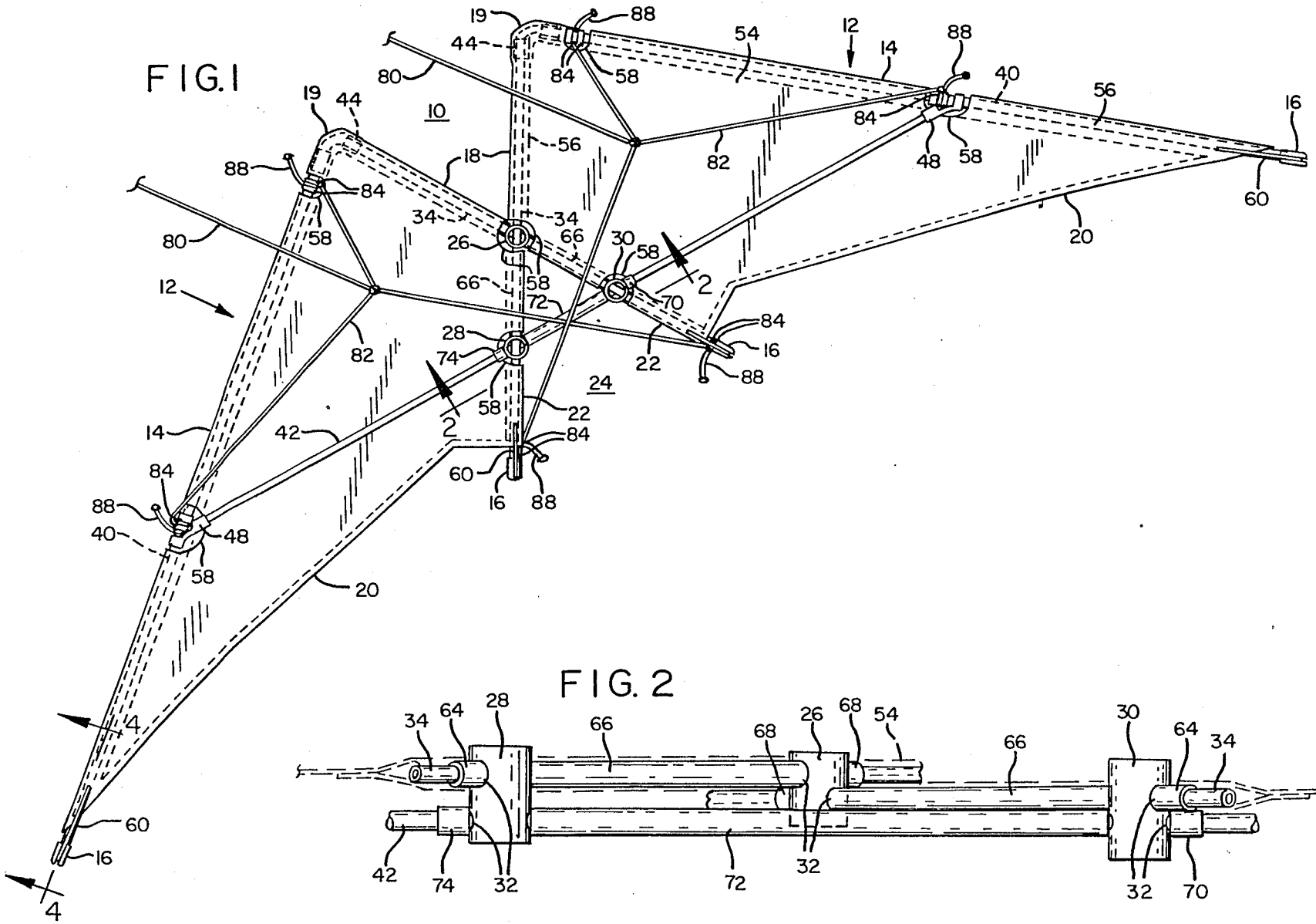
FIG. 1 is a bottom plan view of the present kite in flying condition.
FIG. 2 is an enlarged fragmentary sectional view taken on the line 2—2 of FIG. 1.

With reference first to FIG. 1, the kite in its overall appearance resembles a narrow profile Delta wing except that it has a V-shaped front triangular opening 10 at the center. The kite comprises two identical sections 12 each having an elongated swept back leading edge portion 14 extending outwardly to a tip portion 16 and including an angled inner edge portion 18 leading rearwardly toward the other section. Edge portions 18 are divergent toward the front and define the sides of the opening 10. The respective edge portions 14 and 18 meet in nose portions or peaks 19 and form a double nose kite. The rear of each kite section 12 includes a trailing edge portion 20 and a short angled inner edge portion 22 in linear alignment with an edge portion 18 of the other kite section. Edge portions 22 diverge toward the rear and define a rear triangular opening 24 opposite from front opening 10.

Figures 3, 4:
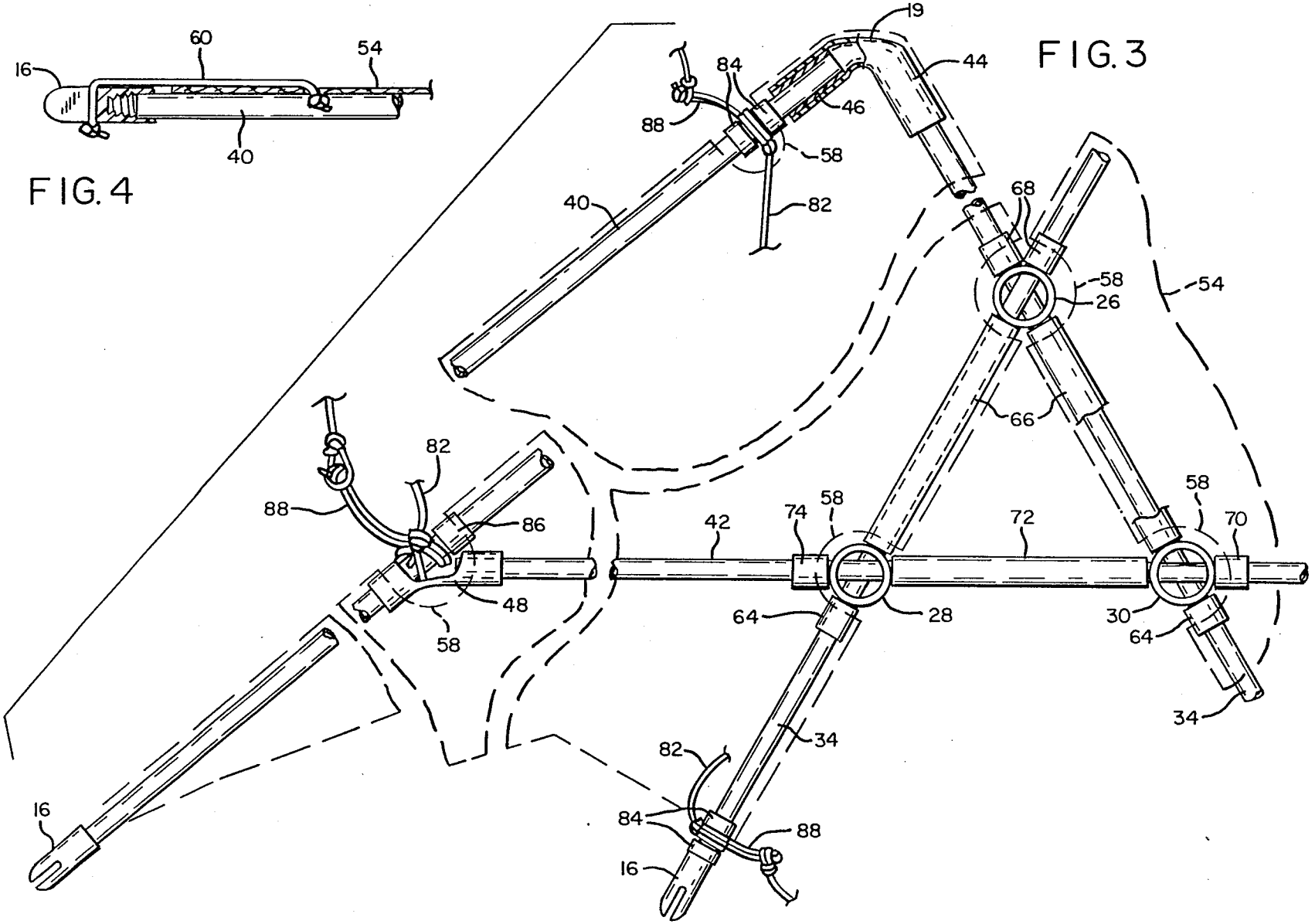
FIG. 3 is an enlarged fragmentary and foreshortened plan view of the frame of the kite, the sail portion of the kite being shown in phantom lines.
FIG. 4 is an enlarged fragmentary sectional view taken on the line 4—4 of FIG. 1.

The two pairs of linearly aligned edges 18, 22 intersect at a central connector 26 associated with two other connectors 28 and 30 in an equilateral triangle. With further reference to FIGS. 2 and 3, each connector 26, 28 and 30 comprises a short cylindrical member having a pair of diametral bores 32 therethrough. The bores of these connectors receive frame members or spars 34 in an arrangement wherein both of the frame members 34 extend through the front connector 26 and each through a rear connector 28 or 30, thus forming the defining edges 18 and 22 of the kite. Frame members 34 intersect at the connector 26 and lead forwardly to the nose portion 19 of the opposite kite section. Other portions of the frame comprise elongated frame members or spars 40 which extend along leading edges 12 and a spreader bar 42 which extends laterally through bores 32 in each connector 28 and 30 and connected to intermediate points of the frame members 40. Spreader bar 42, together with the frame members 34 form the sides of the equilateral triangle secured together by connectors 26, 28 and 30. The free ends of the frame members 40 form the tips 16 of the kite.

Attachment of the frame members 34 and 40 at their nose portions 19 is accomplished by a U-shaped tube 44 in which is fixedly secured, as by adhesive, a pair of rigid sleeves 46 at opposite ends thereof. These sleeves receive the adjacent ends of the frame members 34 and 40 in a tight but forcefully removable friction fit. Nose tubes 44 are flexible sand bent into their U-shape for installing the frame members 34. Attachment of the spreader bar 42 to the frame members 40 is accomplished by double ended connectors 48 one end of which fits securely on the frame member 40 and the other end of which receives an end of spreader bar 42 in a tight but forcefully removable friction fit.

The kite has a sail portion or skin 54 shown in place in FIG. 1 and in phantom in FIG. 3. The frame members 34 and 40 are received in elongated pockets 56 stitched or otherwise formed along suitable edge portions of the sail portion. These pockets are open at the rear or trailing edge of the kite whereby the frame members 34 and 40 can be inserted from this end during assembly. The sail portion has cut-away portions 58 in the area of the connectors 26, 28 and 30 and also in the area of the side connectors 48 for exposing these connectors, and in manufacture the kite is constructed with the nose tube 44 and its inserts 46 in place in the sail portion. The sail portion is provided with elastic cords 60 adjacent the trailing ends of frame members 34 and 40 and such cords are hooked over the tips 16 which are slotted for, this purpose. These cords hold the sail portion tight on the frame and also pull the frame portions together and tightly into the nose portions 19 from each side.

As will now be described, the frame of the kite is reinforced and held in assembled relation, with the assisttance of the sail portion 54, by a series of spacer sleeves, fixed collars and friction collars. In the manufacture of the kite, frame members 34 are each provided with a fixed collar 64 located selectively thereon to provide a proper rear spacing of the connectors 28 and 30 from the nose portions. Frame members 34 are inserted in the pockets 56 from the rear, and as they are thus slid into place a spacer sleeve 66 is placed thereon for mounted positioning between each connector 28 and 30 and the connector 26. Also, a frictionally tight but forcefully movable collar 68 is placed on each frame member 34 at the front side of the connector 26. Spreader bar 42 before assembly is provided with a fixed collar 70 and in assembly is inserted from right to left, as viewed in FIG. 3. As this bar is inserted, a spacer sleeve 72 is placed thereon for mounted positioning between the two connectors 28 and 30. Also, a frictionally tight but forcefully movable collar 74 is placed thereon on the opposite side of connector 28 from the spacer sleeve 72. The spacer sleeves 66, 72, and collars 64, 68, 70 and 74 cooperate with the connectors 26, 28 and 30 to form a triangular core portion for the kite. The spacer sleeves 66 and 72; the fixed collars 64 and 70, and the friction collars 68 and 74 also cooperate to hold the kite frame together as an integral unit.

With the specific structure of the trianglar portions the frame, and particularly the central or core triangle, namely a triangle which comprises an equilateral triangle, a strong frame is provided. Since the frame members 34 and 40 are inserted forwardly from the rear during assembly they can be disassembled in the reverse direction, it merely being necessary to release the leading ends of frame members 34 from the sleeves 46 in the nose connectors 44 by forcefully pulling them out of such sleeves and then pulling the frame members out of the friction sleeves 68 and connectors 26, 28 and 30. Spreader bar 42 is removed by releasing its ends from connectors 48 and then forcefully pulling it to the right, FIG. 2, for disengagement from friction collar 74 and connectors 28 and 30.

Since the frame members 34 can with force be moved toward the trailing edge, namely, friction collars 68 will with sufficient force allow such movement, an impact on one or both nose portions 19, such as a crash to the ground, will drive one or both frame members 34 rearwardly of the other frame portions and absorb a substantial portion of the impact forces, whereby to prevent or reduce damage to the kite in most instances. Repair can be made instantly by forcing the frame member 34 back into place.

The bores 32 in connectors 26, 28 and 30 are specifically located such that both nose portions 19 are at substantially the same flight plane level even though the members have a crossed relation. More particularly and with reference to FIG. 2, spacing of the bores 32 in the connectors and support of the connectors on the rigid spreader bar 42 is such as to locate nose portions 19 of the kite on the substantially common flight plane.

Each of the kite sections 12 has a fly line 80 and a bridle 82 therefor connected to the frame. Such connections comprise one adjacent the nose, one between the leading and trailing edges of the frame member 40, and one at the trailing edge of the frame member 34. Friction collars 84 are located on each side of these bridle connections and are ultimately cemented to the frame members to lock the bridle connections in place. For formation flying, similar kites can be connected in parallel stacked and spaced relation from the main kite. The connections between the kites are accomplished by tie lines 88 leading from the bridle connecting points 84.

According to the invention, a stunt kite is provided that has great flight efficiency, good structural rigidity, and attractive appearance. The efficiency in flight results from its narrow profile and wide span, such structure making it highly maneuverable, fast turning, and readily responsive to the operator. The two sections resemble a bird's wing in flight, namely, the two peaked leading edges look like and accomplish the same maneuverability as peaked wing portions of a bird. The two peaked leading edges and open wing portions 10 and 24 allow one wing to be turned over the other for changing directions. The particular structure of the frame which puts the two nose portions in substantially the same flight plane contributes to the efficiency in flight. Also, the triangular frame portions make for a strong kite but one which can release the frame members 34 rearwardly and thus protect the frame in the event of the impact of a nose section with the ground. The two kite sections are identical and thus capable of economical manufacture.

The kite can readily be disassembled by releasing the elastic cords 64 from the ends 16 and disconnecting the spreader bar 42 at its ends, and then pulling the frame members 34 and 40 rearwardly and the spreader bar to the right. If desired, the kite can be partially disassembled by removing only the frame members 34 and the spreader bar 42. In this case, the kite can be compacted by swinging the frame members 40 together into parallel relation, or, the kite can be readily compacted by merely removing the spreader bar and swinging frame members 34 inwardly into abutment with the center frame portion by flexing connecting tubes 44. Although the overall shape of the kite will not vary appreciably, it is within the concept of the invention to contour the trailing edges thereof to resemble specific flying animals such as swifts, hawks, bats, and the like. Also, the angle of the elongated leading edges 12 can be varied by utilizing different length spreader bars 42 and of course customizing the skin 54 to fit.

It is to be understood that the form of my invention herein shown and described is to be taken as a preferred example of the same and that various changes in the shape, size and arrangement of parts may be resorted to without deparing from the spirit of my invention, or other scope of the subjoined claims.

Having thus described my invention, I claim:

1. A kite construction comprising:

a pair of identical wing sections, frame means at the front of each wing section extending outwardly to a side tip at a rearwardly directed angle and forming leading edges for the kite;

said frame means also including a pair of inwardly disposed extensions leading rearwardly from respective leading edges at spaced points and at an angle to define the sides of a triangular space between said leading edges;

said pair of extensions extending across each other at an angle and forming two sides of a triangle in said frame means;

said frame means also including a laterally extending spreader bar connected to intermediate portions of the leading edge of said front frame means and crossing said pair of extensions to form a closed frame reinforcing triangle;

connectors securing said pair of extensions and said spreader bar together in triangular relation;

a sail portion on said kite fitted on said frame means and forming a trailing edge;

and bridle means arranged for attachment to a fly line.

2. The kite construction of claim 1 wherein said connectors have diametral bores receiving said extensions and said spreader bar, said bores having offset relation that positions said pair of extensions at their leading edges in substantially the same flight plane.

3. The kite construction of claim 2 including abutment and friction collars on said extensions and said spreader bar arranged to hold said extensions and said spreader bar in said triangular relation.

4. The kite construction of claim 2 including abutment and friction collars on said extensions and said spreader bar arranged to hold said extensions and said spreader bar in said triangular relation, and spacer means on said extensions and said spreader bar between said connectors.

5. The kite construction of claim 2 wherein said extensions are releasably secured to said frame means at the front and said spreader bar is releasably secured to said frame means for disassembly, and including abutment and friction collars on said extensions and said spreader bar arranged to hold said extensions and said spreader bar in said triangular relation but releasable in a rearward direction for disassembly.

6. The kite construction of claim 2 including abutment and friction collars on said extensions arranged to hold said extensions in said triangular relation but allowing release of said extensions in the event of an impact on said leading edges.

7. A kite construction comprising:

frame means including a pair of frame members at the front extending outwardly to side tips at a rearwardly directed angle and forming a leading edge for the kite;

said frame means also including a pair of inwardly directed extensions;

said extensions leading rearwardly from said leading edge at spaced points to form a double nose on said leading edge and defining a triangular unobstructed opening in said frame between said noses;

a sail portion on said kite fitted on said frame means and forming a trailing edge;

and bridle means arranged for attachment to a fly line.

8. The kite construction of claim 7 including a triangular opening in the trailing edge of said kite also defined by said extensions, said triangular opening being equal and opposite to said triangular opening in said leading edge.

9. The kite construction of claim 6 including tension means secured between said extensions and said sail arranged to assist in holding said extensions in said triangular relation and also to assist returning said extensions to their original position after release thereof from an impact.

* * * * *